United States Patent [19]

Waters et al.

[11] 3,946,196

[45] Mar. 23, 1976

[54] HAIR CURLING APPLIANCE

[75] Inventors: Robert S. Waters; Meyric K. Rogers, both of Lancaster, Pa.

[73] Assignee: Schick Incorporated, Lancaster, Pa.

[22] Filed: June 13, 1974

[21] Appl. No.: 478,896

[52] U.S. Cl. ..... 219/222; 132/9; 132/32 R; 132/33 R; 132/37 R; 219/242; 219/521

[51] Int. Cl.[2] ... H05B 1/00; A45D 1/20; A45D 4/12

[58] Field of Search ..... 219/222–226, 219/242, 533, 521, 385; 126/408, 409, 226, 235–237; 132/7, 9, 31 R, 32 R, 33 R, 34 R, 37 R, 37 A, 39

[56] References Cited

UNITED STATES PATENTS

| | | | |
|---|---|---|---|
| 397,159 | 2/1889 | Weldon | 132/37 R |
| 793,158 | 6/1905 | Rolfe | 219/242 |
| 793,229 | 6/1905 | Rolfe | 219/242 |
| 923,539 | 8/1909 | Demhard | 219/242 |
| 1,146,758 | 7/1915 | Hadaway | 219/242 |
| 1,579,476 | 4/1926 | Dominguez | 219/242 UX |
| 1,625,487 | 4/1927 | Meyer | 219/242 |
| 1,694,725 | 12/1928 | Tabb | 219/242 |
| 1,809,510 | 6/1931 | Churchill | 219/242 UX |
| 3,534,392 | 10/1970 | Trouilhet | 219/225 |
| 3,610,259 | 10/1971 | Brown | 132/37 R |

*Primary Examiner*—A. Bartis

*Attorney, Agent, or Firm*—Lockwood, Dewey, Zickert & Alex

[57] ABSTRACT

A hair curling appliance includes two hair curling wands and a base assembly for heating the wands to a desired temperature. The base assembly includes two overlapping plate-like retention members having trough-like end portions which coact to form sockets for receiving the wands, and center portions which coact to form a cavity for holding an electrical heating element. The wands include hair retaining clamps operable from the handles of the wands, and heat insulating end caps which reduce the possibility of a user coming into accidental contact with the heat transfer portions of the wands.

3 Claims, 11 Drawing Figures

HAIR CURLING APPLIANCE

BACKGROUND OF THE INVENTION

The present invention relates generally to hair curling appliances, and more particularly to a hair curling appliance providing improved operating convenience and manufacturing economy.

Hair curling appliances, which ordinarily consist of one or more curling irons or wands and a base for receiving the wands, have long provided an effective means for imparting curls to hair. The curling wands associated with these appliances have been either of the internally heated type, wherein a heating element, generally electrically powered, is situated within the working portion of the wand to heat the hair as it is looped over the iron, or of the externally heated type, wherein the wand is formed of a material having a high heat coefficient and the base is provided with an electrical heating element for bringing the wand up to a predetermined temperature prior to use.

Of the two types of hair curling appliances, the internally-heated type has the disadvantage of requiring a separate internal heating element for each curling wand and, therefore, is more costly to manufacture. Furthermore, the presence of an electrical connection to the hand-held wand has proven discomforting to some users. For these reasons, the externally-heated type of hair curling appliance has proven more popular for non-commercial consumer use.

Unfortunately, prior-art hair curling appliances of the externally-heated type have been unnecessarily bulky and expensive to construct. This has largely been a result of complications in constructing a suitably compact and inexpensive socket assembly in the appliance base for removably receiving the heating wands, and for heating the wands from a common electrical heating element. Thus, the need has developed for a hair curling appliance which does not require a large, complicated and expensive base assembly, and which provides tapered, easy-to-handle wand assemblies which can be easily manipulated by a user during hair curling operations.

Accordingly, it is a general object of the present invention to provide a new and improved hair curling appliance.

It is another object of the present invention to provide a new and improved hair curling appliance which can be more economically produced.

It is another object of the present invention to provide a new and improved hair curling appliance which is smaller in size and which utilizes small, tapered easy-to-maneuver hair curling wands.

It is another object of the present invention to provide a new and improved hair curling appliance which has a base assembly requiring a minimum number of component parts.

It is another object of the present invention to provide a new and improved hair curling appliance which provides improved protection against inadvertent burns to a user.

SUMMARY OF THE INVENTION

The invention is directed to a hair curling appliance comprising a pair of curling wands, each having a thermally insulated handle portion and a tapered heat retaining working portion, a housing having a pair of spaced apertures dimensioned to receive substantially the entire working portions of respective ones of the curling wands, an electric heating element, and means comprising a pair of heat-conductive retaining members in thermal communication with the heating element, the members having center portions forming a cavity for receiving the heating element and trough-like inwardly facing end portions extending coaxially to respective ones of the wand-receiving apertures substantially the length of the working portions of the wands to form a pair of sockets within the housing for receiving the curling wands.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
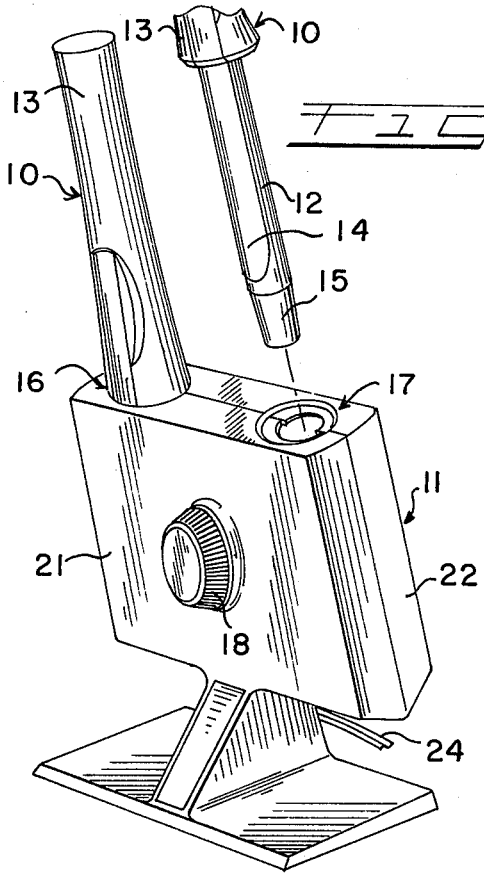
FIG. 1 is a perspective view of the hair curling appliance of the invention showing one curling iron seated in its receptacle in the base and the other curling iron removed from its receptacle for use.

Referring to FIG. 1, the hair curling appliance of the invention is seen to comprise two hand-held curling wands 10 and a pedestal-mounted base assembly 11 for heating the wands to a temperature suitable for curling hair. The curling wands 10 each include a heated cylindrical work portion 12 around which the hair is wrapped during the curling operation, a heat-insulated handle portion 13 with which the user holds the wand, a pivotally mounted hair clamp member 14 for gripping loose ends of hair prior to wrapping the hair around the wand, and an insulated tip portion 15 for guarding against inadvertent burns to the user. When the wands are not being used to curl hair, the working portions 12 are normally inserted through respective ones of two wand-receiving apertures 16 and 17 in the base 11 to be received by a socket assembly therein.

The main or body portion of the base 11 is held in an upwardly inclined position by means of a flat pedestal which extends between the underside of the body portion and an underlying supporting surface. The temperature to which the working portions 12 of the curling wands 10 are heated is controlled by a temperature control knob 18 located on the front face of the base assembly.

Figure 6:
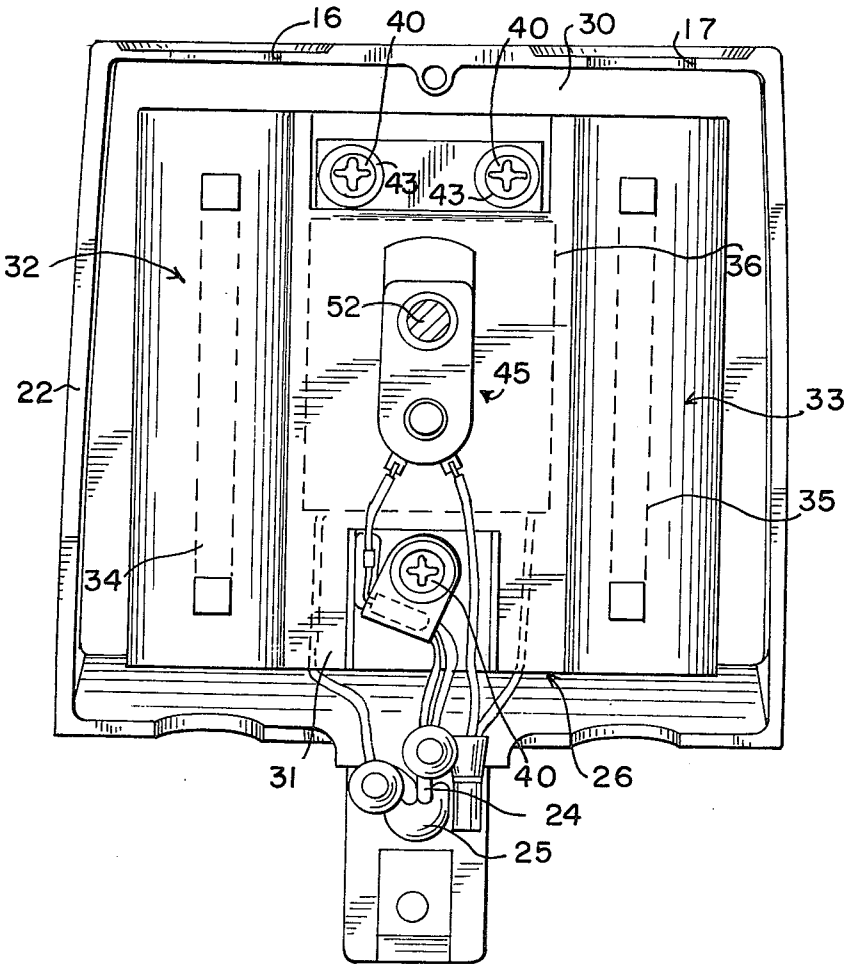
FIG. 6 is a cross-sectional view taken along line 6—6 of FIG. 5.
Figure 5:
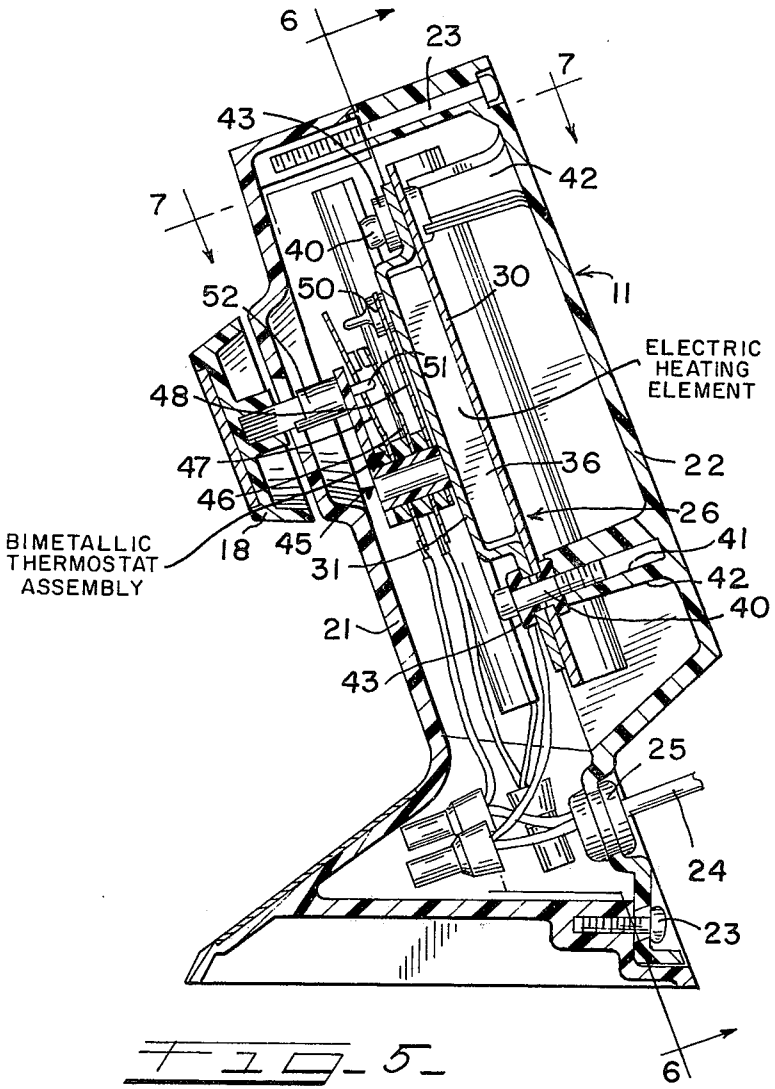
FIG. 5 is a cross-sectional view taken along lines 5—5 of FIG. 3.

Referring now to FIGS. 5 and 6, the housing 20 for base assembly 11 comprises a front housing section 21 and a rear housing section 22, each of which may be molded from an impact-resistant high-temperature plastic. The two sections are held together by threaded fasteners 23 which extend through apertures in the rear section 22 and into threaded bores in the front section 21. A power cord 24 for supplying power to the appliance passes through the rear housing section 22 and is attached thereto means of a grommet 25 or similar fastener.

Figure 2:
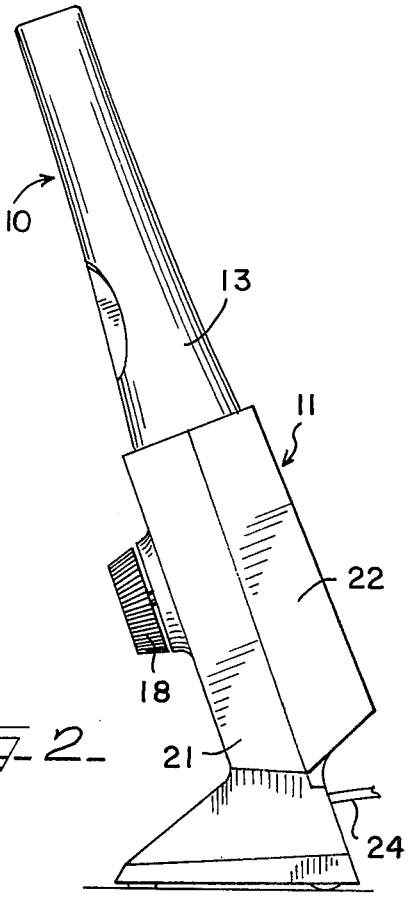
FIG. 2 is a side elevational view of the hair curling appliance of FIG. 1.
Figure 3:
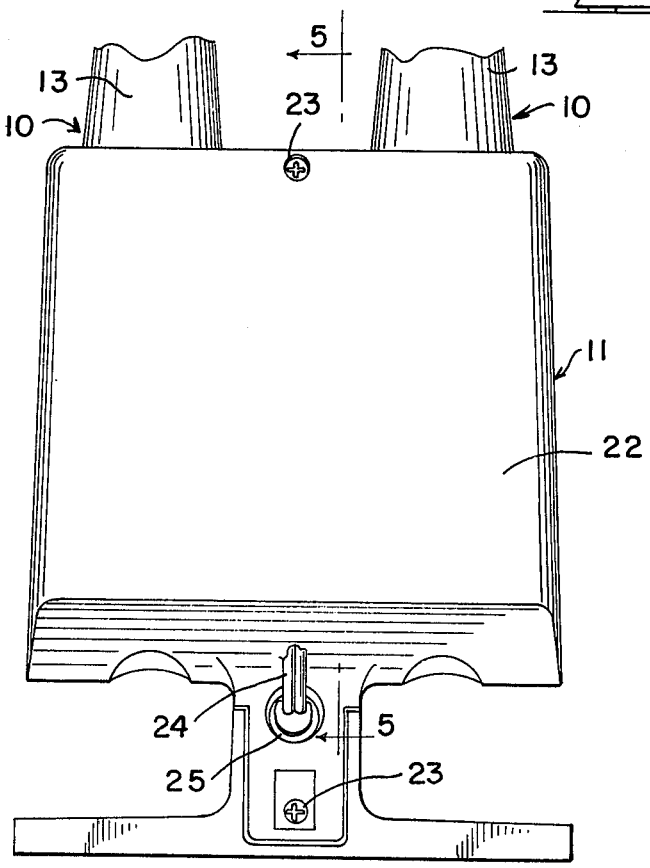
FIG. 3 is a rear elevational view of the hair curling appliance of FIG. 1.

To transfer heat to the working portions of the two curling wands, base assembly 11 includes, in accordance with the invention, a novel socket assembly 26 for receiving and transferring heat to the working surfaces 12 of respective ones of the two curling wands 10. This assembly comprises brackets or wand retaining members 30 and 31, each formed from a thin rectangular sheet of heat-conductive material such as steel. Each of the retaining members includes a flat center portion and trough-like end portions, the spacing between the end portions corresponding substantially to that of the wand-receiving apertures 16 and 17 in the base housing, as viewed in FIGS. 1–3. The trough-like end portions of the two retaining members face inwardly to form individual cylindrically-shaped sockets 32 and 33 for receiving the working portions 12 of the hair curling wands 10. Since the end portions on the respective brackets are spaced identically to the wand-receiving apertures 16 and 17 in the base housing, the wands when inserted through these apertures automatically fall into alignment with the sockets and are slidably received therein.

Figure 8:
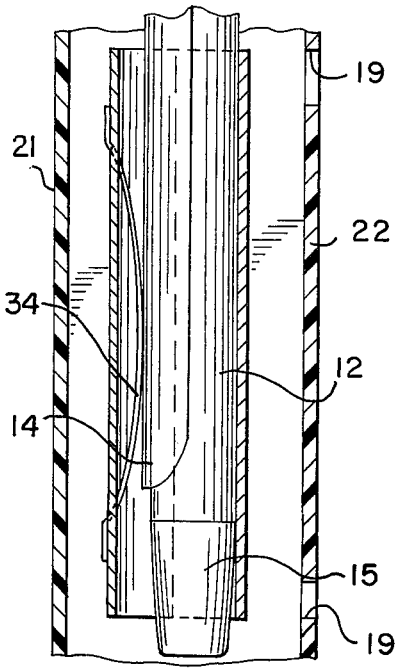
FIG. 8 is an enlarged cross-sectional view taken along lines 8—8 of FIG. 7 showing one of the curling wands seated in its socket assembly.
Figure 4:
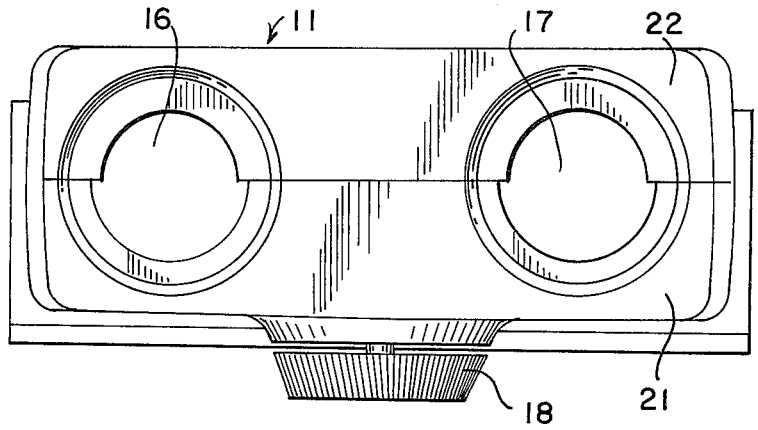
FIG. 4 is a top plan view of the hair curling appliance of FIG. 1.
Figure 7:
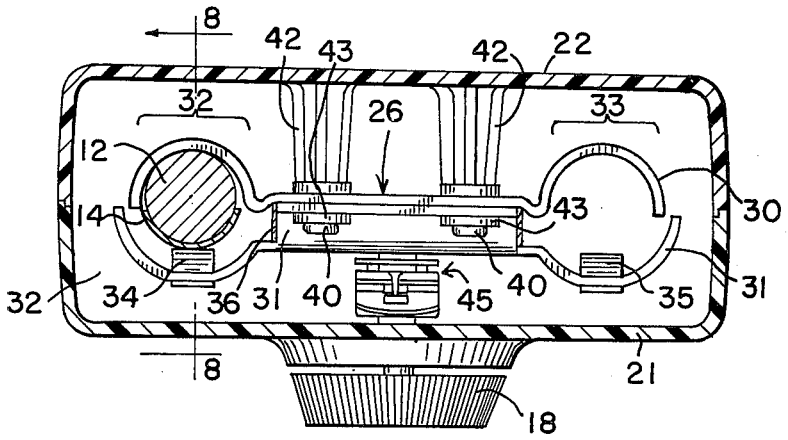
FIG. 7 is a cross-sectional view taken along lines 7—7 of FIG. 5.

To obtain optimum heat transfer to the hair curling wands the inside surfaces of the trough-like end portions of retaining members 30 have a radius of curvature which corresponds substantially to the outside radius of the working portion 12 of the wands. Close uniform engagement is assured between retaining member 30 and the wands by providing longitudinally extending spring steel strips 34 and 35 on the inside surfaces of the trough-like portions of the other retaining member 31. As can be seen in FIGS. 7 and 8, these spring strips bear against the clamp members 14 of the wands to force the opposite surfaces of the working portions 12 into engagement with the inside surface of retaining members 30. The margins of the wand-receiving apertures in the base housing are keyed with a semi-circular portion of reduced diameter to assure that the wands will always be inserted into the sockets with the correct orientation so that the spring strip will bear against the clamp 14 and not against the working surfaces 12 of the wands. This prevents unnecessary wear of the working surfaces during repeated use.

In further accord with the invention the central portion of wand retaining member 31 is formed away from the central portion of member 30 to define a space or cavity between the two brackets. This cavity is dimensioned to receive an electrical heating element 36, which, by reason of its close physical proximity to the two retaining members, serves to heat both of the brackets and any curling wands contained in the socket assemblies formed by the members.

Retaining members 30 and 31 are mounted to the rear section 22 of the base housing by means of three threaded fasteners 40, which engage complementarily threaded bores 41 on posts 42 molded into the inside surface of the housing. To protect housing 20 from the deformation or discoloration from exposure to the heated retaining members, the fasteners are preferably attached to the retaining members by means of heat-insulating grommets 43 formed of a flexible high-temperature material. The mounting holes provided in members 30 and 31 for receiving fasteners 40 are preferably over-sized to accommodate grommets 43 and to avoid contact between the members and the fasteners.

For optimum versatility the temperature to which the hair curling wands 10 are heated is preferably user-adjustable to accommodate different types of hair and different hair setting conditions. To this end, the base 11 of the appliance includes an electrical thermostat assembly 45 user-controllable from the front of the appliance. This thermostat assembly includes a pair of spring contacts 46 and 47 electrically connected in series with heating element 36, and a bimetallic strip 48 attached at one end to the front surface of bracket 31. The other end of strip 48 includes an electrically non-conductive spacer 50 which bears against contact 47, so that as the temperature of heating element 36, and hence members 30 and 31 and the working portions 12 of curling wands 10, increases, contact 47 is bent away from contact 46 as strip 48 expands outwardly until the contacts eventually open and power is removed from the heating element. As strip 48 subsequently cools, contacts 46 and 47 eventually close to restore power to the heating element and begin the heating cycle anew.

To enable the user to adjust the operating temperature of the thermostat the position of contact 46, and hence the point or temperature at which the contacts will separate, is made user-adjustable from the front panel. This is accomplished by means of a shaft 51, which is connected to the temperature control knob 18, and a cam bearing block 52 which causes the shaft to move either inwardly and outwardly, depending on the position of knob 18. Since the free end of shaft 51 bears against contact 46, rotation of knob 18 repositions contact 46 and sets the temperature at which the contacts open.

Figure 9:
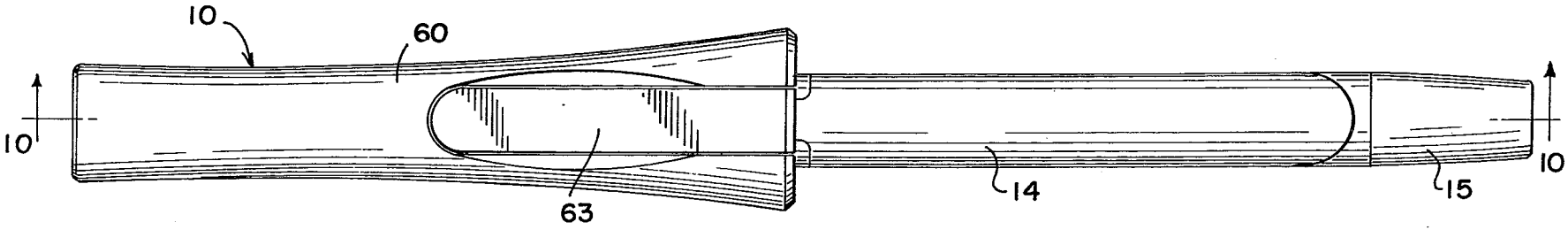
FIG. 9 is a top elevational view of one of the curling wands utilized by the appliance.
Figure 10:
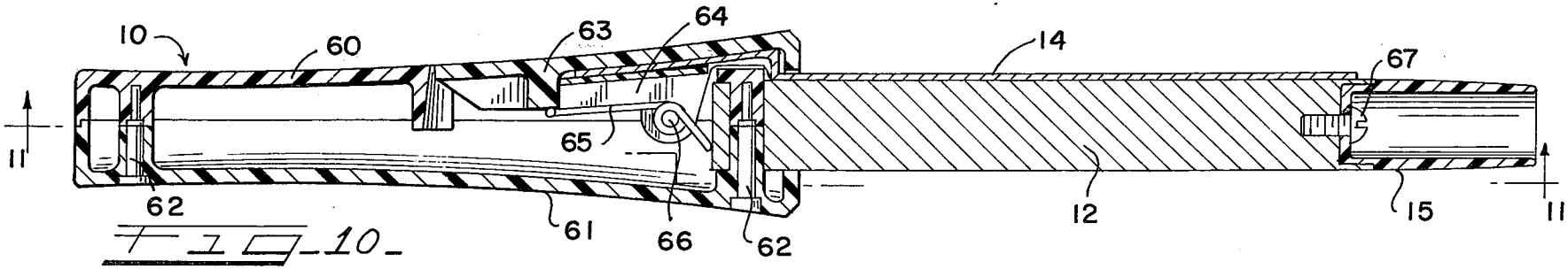
FIG. 10 is a cross-sectional view taken along lines 10—10 of FIG. 9.
Figure 11:
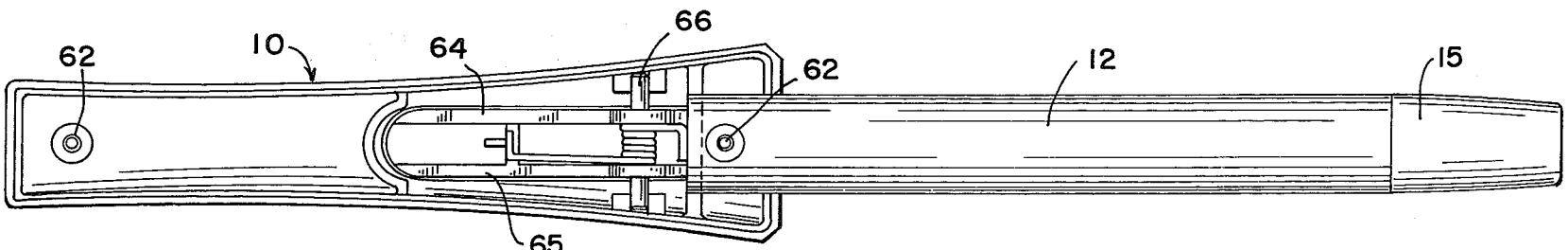
FIG. 11 is a cross-sectional view taken along lines 11—11 of FIG. 10 showing the pivotal attachment between the hair retaining clamp and the handle of the curling wand.

The two hair curling wands 10 have been previously described as each comprising a handle portion 13, a working or body portion 12, a protection cap 15, and a hair clamp member 14. Referring to FIGS. 9–11, the handle portion 13, which may be fabricated of a heat-insulating plastic material, is preferably tapered so as to increase in diameter adjacent the working portion 12 to provide a more convenient gripping surface and to protect the user from inadvertent contact with the heated working surface. The working portion 12 in the illustrated embodiment is preferably cylindrical and formed of a metal having a high heat conductivity, such as aluminum. However, it will be appreciated that the working portion may be oval or multi-faceted in cross section, and may be formed of other materials, such as stainless steel, or have a shell of such material filled with a material such as wax having a high heat retention capability. The cylindrical working portion 12 and/or the protector cap 15 may be provided with a taper for ease of insertion into the wand-receiving sockets 32 and 33, and to provide a more aesthetically pleasing appearance. It will be understood that the wand-receiving sockets 32 and 33 and the trough-like portions of wand-retaining members 30 and 31, would be dimensioned as required by the particular shape of the working portions 12 for smoothly receiving the wands.

Referring to FIG. 10, the handle portion 13 of the hair curling wand 10 preferably comprises a hollow housing consisting of an upper housing section 60 and a lower housing section 61. The two sections are fastened together by means of threaded fasteners 62 which extend through apertures in section 61 and into threaded bores in section 60.

The hair retaining clamp 14, which extends the entire length to the working portion of the wand, is preferably pivotally mounted to the wand near handle portion 13 so that it can be opened and closed at will by the user to hold loose hair ends prior to twisting the wand to initiate the curling operation. The hair retaining clamp consists of an elongated metal strip formed at one end to substantially correspond to the outside surface of the working portion 12 of the wand, so that as the clamp lies retracted against the wand a substantially uniform rounded surface is presented. A portion of the working surface may be recessed to receive the clamp, thereby forming a more uniform surface when the wand is retracted.

The clamp 14 is pivotally mounted to the housing sections of the handle so that it can be conveniently opened to receive or release hair from the wand. To this end, the clamp is provided with a flanged portion 64 which extends back into the hollow inside portions of the handle housing sections 60 and 61. The flat center of portion 64 is attached to an actuator bar 63 which provides a heat-insulated surface which the user can conveniently depress to pivot the clamp away from the working portion of the wand. The vertically-extending flanges on either side of portion 64 each includes an aperture for receiving a transversely-extending pivot pin 66, which is seated in recesses molded into housing sections 60 and 61 to provide a pivotal axis for clamp 14. A wire spring 65, disposed around pin 66 biases clamp 14 into its retracted position against the surface of the working or heat transfer portion 12. One end of this spring bears against the flanged rear portion 64 of clamp 14 and the other end bears against the handle end of portion 12.

The tip of the heat transfer portion 12 is provided with cap 15 to lessen the possibility of accidental burns from unintentional user contact with the heat transfer surface. This cap, which comprises a hollow generally cylindrical member formed of a suitable high-temperature low heat conductivity plastic, is attached to the end of the working portion or body of the wand by means of a threaded fastener 67 or other appropriate fastening means.

In use the two curling wands 10 are inserted into respective ones of the receptacles 16 and 17 and the temperature control 18 is set to the desired temperature. After the desired temperature has been reached, one of the wands may be removed and utilized in a conventional manner by wrapping the loose ends of hair to be curled around the working portion of the wand. The clamp may be utilized to assist in this operation by holding the loose ends in position prior to initiating the wrapping.

When the first-used wand has cooled to the point where it is no longer at a sufficiently high temperature for hair curling, the wand is returned to its receptacle and the other wand, which in the meantime has been maintained at the desired temperature, is removed for use. While the second wand is being used the first wand is being reheated for subsequent use.

The present appliance provides an efficient and convenient-to-use appliance for curling hair. By reason of its unique construction, which requires a minimum number of component parts, the appliance is convenient to use, and economical to construct and manufacture. Furthermore, since the base of the appliance has no exposed heated surfaces, and since a protector cap is provided to prevent accidental contact with the ends of the heat transfer portion of its curling wands, the danger of unintentional burns to a user is minimized.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A hair curling appliance comprising, in combination:

a pair of curling wands, each having a thermally insulated handle portion and a heat retaining working portion;

a housing having a pair of spaced apertures dimensioned to receive substantially the entire working portions of respective ones of said curling wands;

an electric heating element in said housing; and means comprising a pair of juxtaposed heat-conductive retaining members in said housing in thermal communication with said heating element, said member having center portions forming a cavity wherein said heating element is received in captive engagement when said retaining members are joined, and trough-like inwardly facing end portions extending coaxially to respective ones of said wand-receiving apertures substantially the length of said working portions of said wands to form a pair of sockets within said housing for receiving said curling wands.

2. A hair curling appliance as defined in claim 1 wherein said trough-like end portions are substantially semicylindrical, and said working portions of said curling wands are cylindrical and tapered.

3. A hair curling appliance comprising, in combination:

a pair of curling wands, each having a thermally insulated handle portion and a heat-retaining work portion;

a base including a housing having a pair of apertures for receiving the work portions of said curling wands, said apertures having a predetermined center-to-center spacing;

an electric heating element in said housing;

a first retaining member in said housing of thin heat-conductive plate material having a center portion and first and second trough-like end portions, said end portions being located at opposite ends of said plate and having a spacing between their axes corresponding to said predetermined spacing between said wand-receiving apertures;

a second retaining member in said housing of thin heat conductive plate material having a center portion and first and second trough-like end portions, said end portions being located at opposite ends of said plate and having a spacing between their axes corresponding to the spacing between said wand-receiving apertures, said center portion of said second retaining member adapted to form in conjunction with said center portion of said first retaining member a cavity therebetween for receiving in captive engagement said heating element; and means for mounting said first and second retaining members within said housing in overlapping relationship with said trough-like end portions inwardly concave and in axial alignment with said wand-receiving apertures and said electric heating element contained within said defined space between said members whereby a combination retaining socket and heat transfer assembly is formed for said curling wands.

* * * * *